US006648575B2

(12) United States Patent
Baroncini

(10) Patent No.: US 6,648,575 B2
(45) Date of Patent: Nov. 18, 2003

(54) DEVICE FOR FEEDING ARTICLE TO A BLISTER BAND

(75) Inventor: Ivano Baroncini, Osteria Grande (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 301 days.

(21) Appl. No.: 09/890,429

(22) PCT Filed: Dec. 7, 2000

(86) PCT No.: PCT/IB00/01813

§ 371 (c)(1),
(2), (4) Date: Nov. 7, 2001

(87) PCT Pub. No.: WO01/42088

PCT Pub. Date: Jun. 14, 2001

(65) Prior Publication Data

US 2002/0136619 A1 Sep. 26, 2002

(30) Foreign Application Priority Data

Dec. 7, 1999 (IT) ..... B099A0667

(51) Int. Cl.[7] ..... B65B 35/34

(52) U.S. Cl. ..... 414/300; 414/404; 53/235; 53/246; 53/247; 53/249; 53/250

(58) Field of Search ..... 414/300, 404; 53/235, 244, 246, 247, 249, 250

(56) References Cited

U.S. PATENT DOCUMENTS

| | | | | |
|---|---|---|---|---|
| 3,545,164 A | * | 12/1970 | Middleton | 53/26 |
| 4,693,057 A | * | 9/1987 | Rittinger et al. | 53/247 X |
| 5,415,321 A | * | 5/1995 | Gehlert et al. | 221/68 |
| 5,737,902 A | * | 4/1998 | Aylward | 53/246 X |

FOREIGN PATENT DOCUMENTS

| | | |
|---|---|---|
| GB | 835 320 | 5/1960 |
| GB | 1 208 674 | 10/1970 |

* cited by examiner

*Primary Examiner*—Steven A. Bratlie
(74) *Attorney, Agent, or Firm*—William J. Sapone; Coleman Sudol Sapone, P.C.

(57) ABSTRACT

A device (100) for feeding articles (2) to a blister band (3) moving below and having at least one row of blisters (3*a*) made therein for receiving corresponding articles (2). The row of blisters is parallel to the blister band forward direction (W). The device (100) has a grid (G) situated over the blister band (3), with at least one longitudinal channel (9), facing the longitudinal row of blisters (3*a*). A station (101) is provided for feeding the articles (2) to the grid (G), while oscillating means (10,20) generate a relative oscillating motion between the grid (G) and the corresponding blister band (3), to facilitate stabile introduction of the articles (2) into the corresponding blisters (3*a*) present along said longitudinal channel (9).

19 Claims, 5 Drawing Sheets

FIG.4a
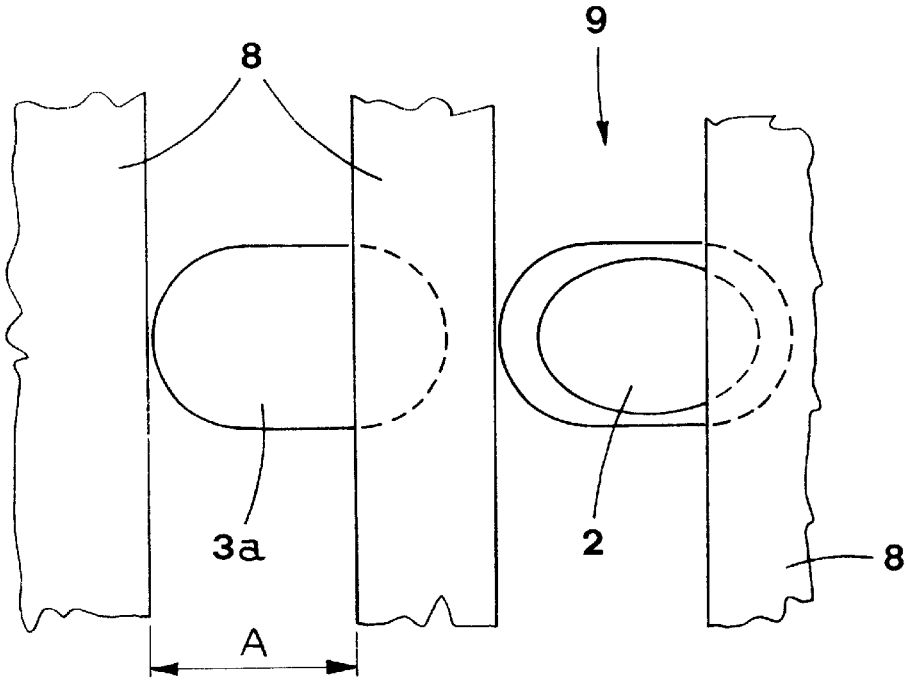
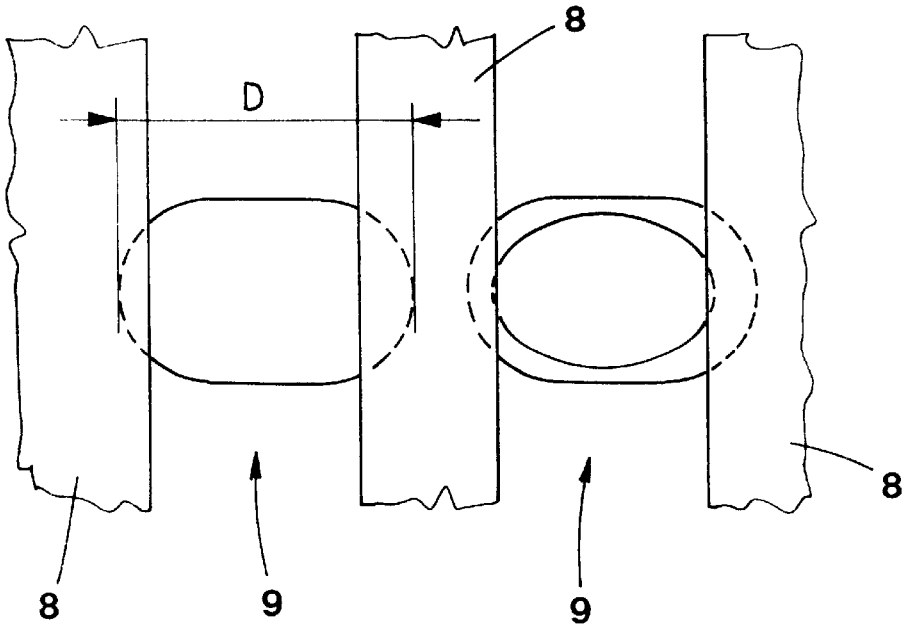
FIG.4b

DEVICE FOR FEEDING ARTICLE TO A BLISTER BAND

BACKGROUND OF THE INVENTION

The present invention relates to automatic packaging, into blister packs, of various articles, such as tablets, pills, capsules and the like, in particular rhomboid and/or oblong.

In the described case, the present invention relates to a device for feeding articles to a blister band.

DESCRIPTION OF THE PRIOR ART

At present, pharmaceutical products are packaged into blister packs, formed by a strip formed with a series of blisters for containing articles.

The strip is usually closed by a sheet of e.g. aluminium, and the articles are withdrawn, according to known techniques, by breaking the aluminium sheet.

The blister packs are obtained by forming, in a suitable molding station, one or more rows of blisters in a continuous band of appropriate material, usually heat-formable or aluminium; afterwards the blister band passes through a filling station, where at least one article is introduced into each obtained blister; finally, the blister band is definitely closed by applying and welding an aluminium film on the surface thereof.

The filled and sealed blister band is cut into strips containing a predetermined number of blisters, therefore, articles, which define each a blister pack.

To fill the blisters of the blister band with articles, known machines are used, which operate according to different techniques.

A particularly widely used apparatus includes substantially a box-like container, which contains a bulk of articles and is situated directly over the blister band. The bottom of the container features an opening, whose width is not bigger than the width of the blister band.

The band is driven to translate with the empty blisters turned toward the container, so that the blisters pass gradually and longitudinally under the container.

The container, cooperating with spreading means, which are usually rotating and use brushes and similar elements, is fed by a suitable feeding channel which conveys the articles to be introduced, through the container, into the blisters. The quantity of the fed articles is such that they can accumulate on the surface of the blister band.

Consequently, the accumulated articles tend to enter the empty blisters and translate together with the belt, thus leaving the container.

A system like the one described above can be used with the belts moving in an intermittent or continuous way, and does not create the problem of the articles alignment with respect to the corresponding blisters.

Another known system for filling blisters includes a plurality of feeding channels, in which the articles are piled, and each channel is situated over a longitudinal row of blisters on the blister band.

The lower end of the feeding channels skims the surface of the band, and in phase relation with the band movement, the articles fall into the respective blisters, due to gravity, when they pass under the feeding channel.

The upper end of the channels is connected in a parallel way with a feeding hopper, which vibrates, and inside which the articles are contained in bulk.

Consequently, the vibrations of the hopper facilitate the orderly introduction of the articles in each feeding channel.

A further system for filling blisters includes a vibrating hopper, in which the articles are contained in bulk, and the bottom of which features suitable means for outputting the articles.

The shape of the output means is such that they direct the articles into substantially vertical feeding channels, in which the piled articles go down due to gravity until they enter the corresponding facing blisters of the blister band.

The output means usually include two rolls, mutually tangent and counter-rotating, so as to separate the articles contained in the vibrating hopper by pushing them upwards against their weight.

The rolls form relative circumferential grooves which define mouths allowing the articles to pass and to be conveyed to the relative feeding channels.

The speeds of the rolls can be different from one another, or any of the rolls can be kept motionless.

The output means can also include one roll mutually tangent to a lateral wall of the vibrating hopper.

According to a variant of the above system, it is possible to place a rotating cylinder between the blister band and the downstream end of the feeding channels.

The rotating cylinder features, on its outer surface, suitable recesses for receiving the articles let out by the feeding channels and positioning them into the blisters.

In this case, each recess is connected with a suction system, which allows to keep the article coming, due to gravity, from the feeding channels, and to a pressure system, which allows to eject the article and introduce it into the facing blister.

However, all the above described known systems have a series of problems due to the typical characteristics of the filling technique being used.

First of all, the articles, specially if very fragile, can be scratched or chipped by repeated pushes and reciprocal friction against the band surface, or against the walls of the container or the feeding channels, in other words, the articles can be damaged.

One of the main drawbacks derives from the fact that the blisters are wider than the articles and it happens quite often that a blister is filled with more than one article or not filled at all, because an article which has just entered the relative blister, can be thrown out during the blister band movement, thus leaving the blister empty.

SUMMARY OF THE INVENTION

The object of the present invention is to propose a device for feeding articles, especially tablets, pills and the like, in particular rhomboid and/or oblong articles, to a blister band situated below, which ensures perfect filling of each blister with one article, avoiding at the same time damages to the processed articles as well as to the blister band, all this independently from the shape and dimensions of the articles and relative blisters aimed at containing them.

Another object of the present invention is to propose a filling device which ensures high reliability and productivity in every working condition, without changing the functionality of the whole packing machine.

A further object of the present invention is to propose a device which allows to use any blister band, so as to make it possible to feed the blister bands with articles of different shapes or compositions, as well as to allow a particularly quick and easy packages output adjustment in relation to the packaging cycle characteristics.

Yet a further object of the present invention is to propose a device for feeding the articles, which can be used with any kind of blistering machine, and which is obtained by a simple, extremely practical and reliable, cheap technical solution, which ensures correct packaging of the relative articles into the corresponding blister bands.

The above mentioned objects are obtained, in accordance with the claims, by a device for feeding articles to a blister band moving longitudinally in a forward direction and having at least one row of blisters made therein for receiving corresponding articles, with said row of blisters being parallel to the direction, said device being characterized in that it includes:

at least one grid situated over said blister band, very close thereto, and featuring at least one longitudinal channel, matching with said longitudinal row of blisters, said articles being moved to said longitudinal channel;

a station for feeding said articles to said grid;

first oscillating means and second oscillating means for generating a relative motion between said grid and said blister band, so that said longitudinal row blisters is alternately partially closed and opened to facilitate stabile introduction of the articles in corresponding blisters present along said longitudinal channel.

BRIEF DESCRIPTION OF THE DRAWINGS

The characteristic features of the present invention will be pointed out in the following description of two preferred, but not only embodiments, with reference to the enclosed drawings, in which:

FIGS. 4*a*, 4*b* are fragmentary schematic plan views, considerably enlarged with respect to the previous figures, of a main section of the device in two particularly significant working steps;

BEST MODES OF CARRYING OUT THE INVENTION

Figure 1:
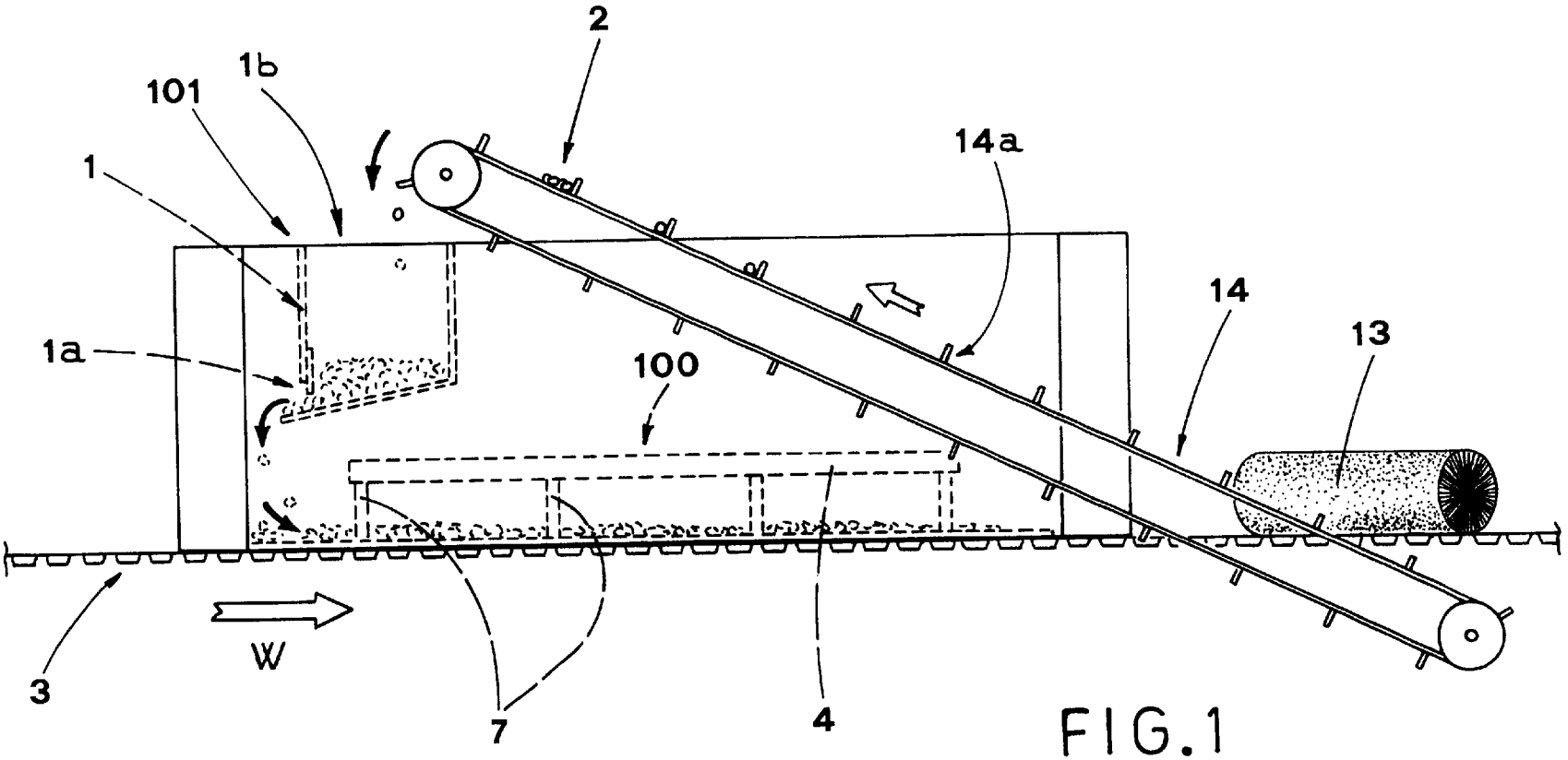
FIG. 1 is a schematic lateral view of the proposed device in a general packaging step.

With reference to the above figures, the reference numeral 3 indicates a blister band with a plurality of longitudinal rows of blisters 3*a* aimed at receiving corresponding articles 2.

Figure 6:
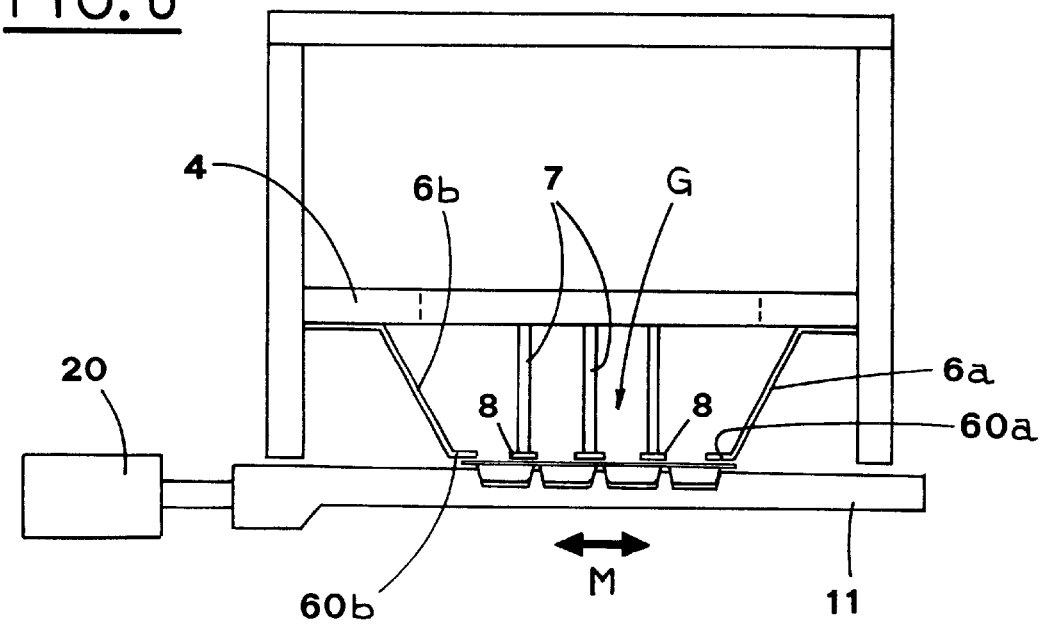
FIG. 6 is a schematic front view, in the same scale as FIG. 3, of the proposed device according to a second embodiment.

The blister band 3, moved longitudinally by known and not shown conveying means in a corresponding movement direction W, is supported and guided by a suitable supporting surface 11 (FIG. 6).

The device 100, being the subject of the present invention, includes substantially a support structure 4, situated over the blister band 3 and featuring, in its lower part, two chutes, first 6*a* and second 6*b*.

The chutes 6*a*, 6*b*, aimed at conveying and delimiting the articles 2 coming from a feeding station 101 to the blister band 3 situated below, have corresponding lower edges, first 60*a* and second 60*b* (FIG. 3), situated substantially immediately above the blister band 3.

The lower part of the support structure 4 supports relative bars 7 (FIGS. 1, 3 and 6), which in turn support a plurality of longitudinal plates 8, in the shown case three. The plates are parallel one to another and extend along the movement direction W. Moreover, the plates are situated substantially immediately above the blister band 3.

Figure 3:
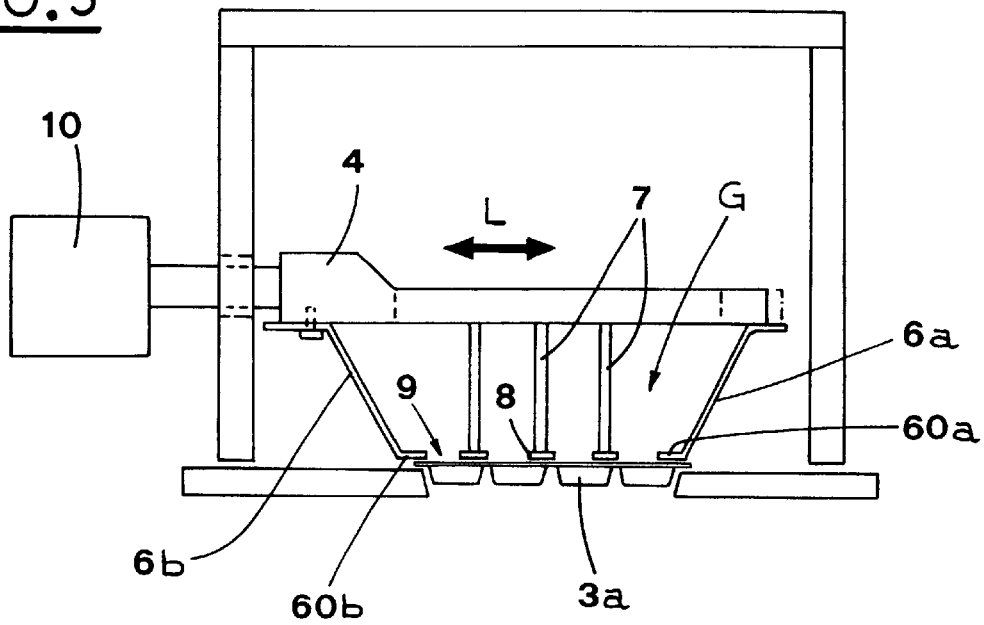
FIG. 3 is a schematic, front view, reduced with respect to the previous figure, of the proposed device according to a first embodiment.

The spaces included between the longitudinal plates 8, or between the extreme plates 8 and the lower edges 60*a*, 60*b* of the chutes 6*a*, 6*b*, define corresponding longitudinal channels 9, in this case four, into which the articles 2 fall (FIGS. 3, 4*a* and 4*b*).

Figure 2:
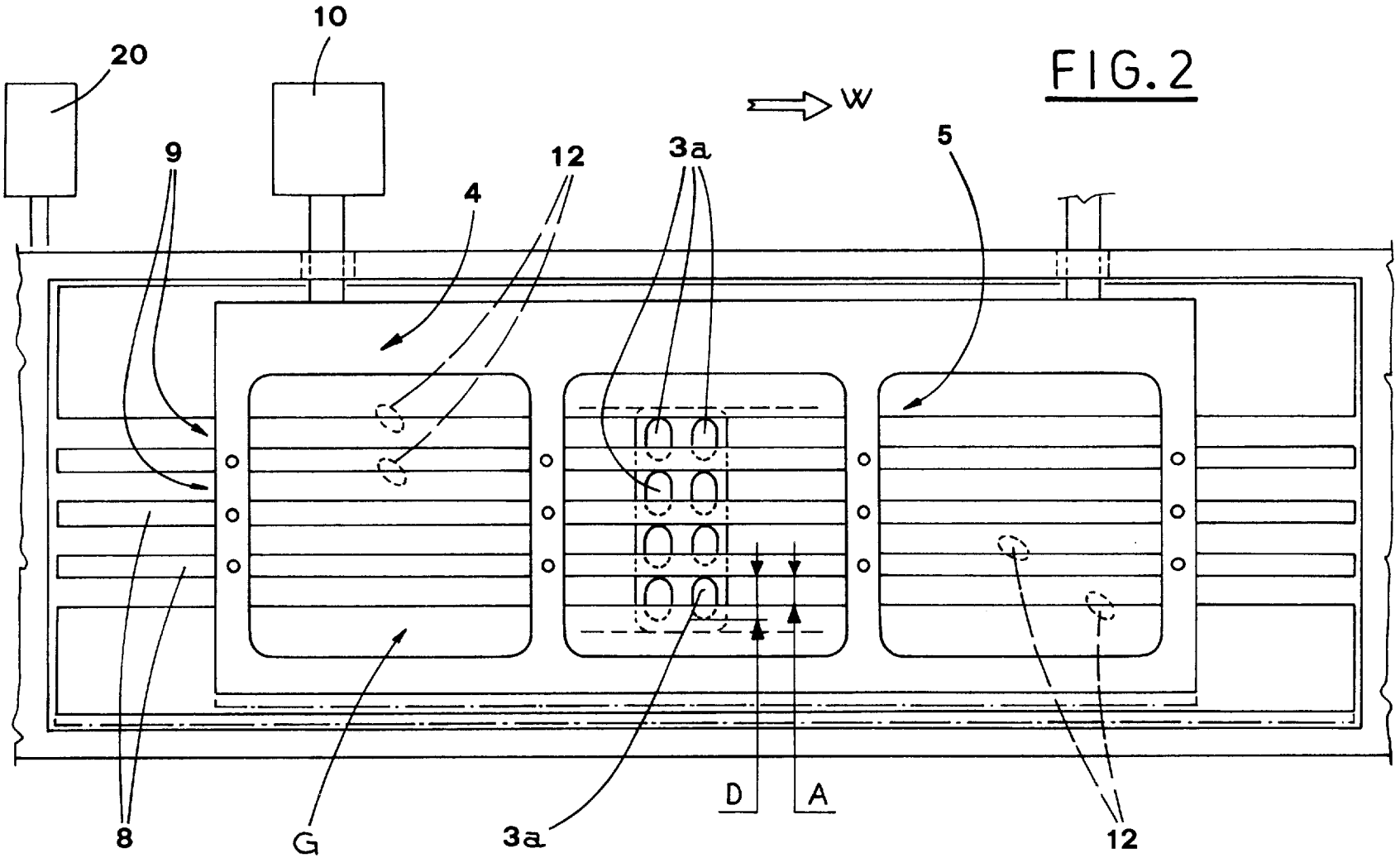
FIG. 2 is fragmentary schematic plan view, enlarged with respect to the previous figure, of the proposed device.

Consequently, the longitudinal plates 8, together with the above lower edges 60*a*, 60*b*, form a kind of grid G defining longitudinal channels 9 (FIG. 2).

Figure 6A:
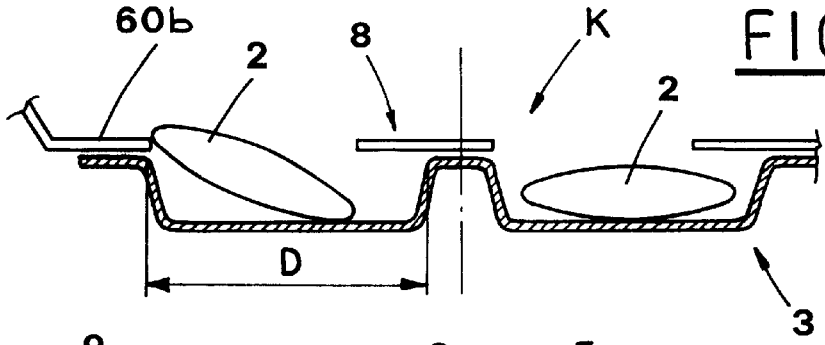
FIGS. 6*a*, 6*b* are fragmentary, schematic, lateral views of the main section of the device shown in FIGS. 4*a*, 4*b*, in the same working steps, according to the second embodiment of the proposed device.
Figure 6B:
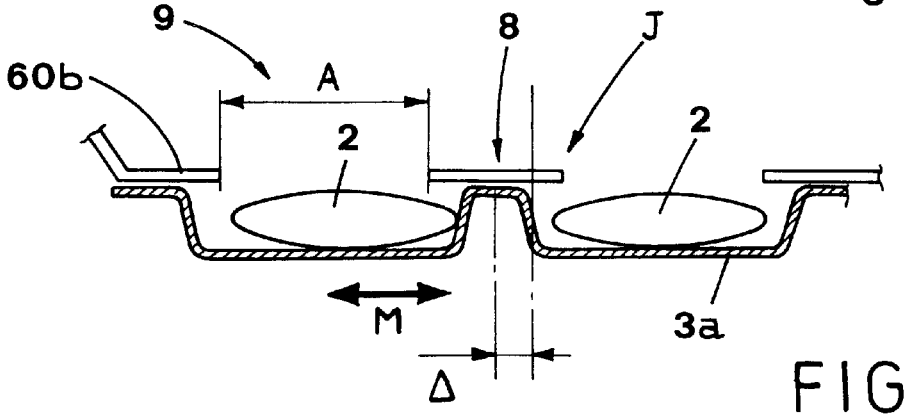

The transversal dimension A of each longitudinal channel 9 is smaller than the transversal dimension D of the single blisters 3*a* (FIGS. 2, 6*a* and 6*b*).

The number of the longitudinal plates 8 is selected so that the number of longitudinal channels 9 perfectly matches the number of longitudinal rows of blisters 3*a* of the band 3, the first facing the others.

Thus, the number of the longitudinal plates 8 must be always one less than the number of longitudinal rows of blisters 3*a* to be filled.

The support structure 4 of the device 100 is also fastened to oscillating means, indicated with a block 10 in FIGS. 2 and 3, and aimed at generating a relative oscillating motion, transversal to the direction W, between the grid G and the blister band 3 facing it.

The feeding station 101 includes a hopper 1, inside which the articles 2 are contained in bulk, and which is situated over the blister band 3.

The upper part of the hopper 1 forms a mouth or inlet section 1*b* for the articles 2 and the lower part thereof forms an opening or outlet section 1*a*, through which the articles 2 go out due to gravity (FIG. 1).

The articles 2, which enter the hopper 1 through the relative inlet section 1*b*, come from a container (not shown) situated upstream of the hopper or from a corresponding close-loop conveying belt 14, fitted with crossbars 14*a* and situated downstream of the support structure 4 with respect to the direction W.

The conveying belt 14 cooperates with a rotating brush 13 of known type, situated very close to the blister band 3 and downstream of the support structure 4 with respect to the direction W.

Operation of the device 100 will be described hereinafter, with reference to an intermediate working step of the working cycle, in which the outlet section 1*a* of the hopper 1 feeds, in a determined time interval, a number of articles 2 exceeding the number of blisters 3*a* facing the grid G during the same time interval.

Figure 5A:
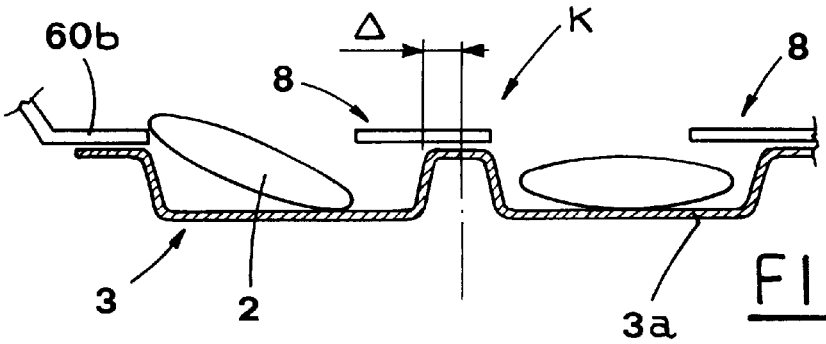
FIGS. 5*a*, 5*b* are fragmentary, schematic, lateral views of the same main section of the device shown in the FIGS. 4*a*, 4*b*, in the same working steps, according to the first embodiment of the proposed device.
Figure 5B:
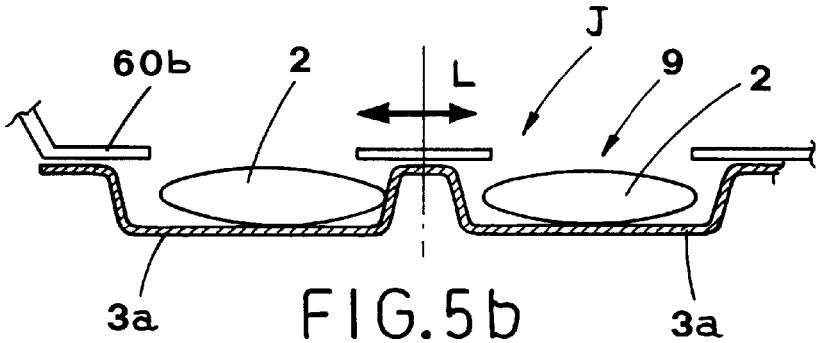

The oscillating means 10, being operating, drive the grid G to oscillate with respect to the blister band 3 below, in a direction L, transversal to the direction W, between an entering position K, in which each article 2 is directed to enter a relative empty blister 3*a* (FIGS. 5*a*, 6*a*), and a stabilization position J, in which each article 2 is situated inside a relative blister 3*a* (FIGS. 5*b*, 6*b*).

Consequently, during the transition from the entering position K to the stabilization position J, the longitudinal axis of each plate 8 is displaced (deviated) by the same value Delta.

The movement of the blister band 3 in the direction W, simultaneously with the oscillating motion of the grid G in the direction L, allows to canalize perfectly the articles 2 inside the longitudinal channels 9.

Therefore, the vibration of the grid G, closes partially the longitudinal rows of blisters 3*a*, so as to facilitate a stabile introducing of the articles 2 situated in the guiding channels 9 into the respective blisters 3*a*, avoiding their casual discharge.

Moreover, this introducing does not damage the articles 2 in any way, preventing from any "guillotine effect" thereon.

The articles 2, which are exceeding downstream of the grid G, i.e. the articles which have not been introduced into the blisters 3*a*, are deviated laterally with respect to the blister band 3 by the brush 13, i.e. they are removed from the blister band.

The blister band 3, downstream of the brush 13, features longitudinal rows of blisters 3*a*, each filled with one article 2; consequently, the articles 2, which have not been introduced into any blister 3*a* of the band 3 are not present on the band 3.

The correct placement and consequent keeping of each article 2 inside a relative blister 3 is facilitated by the transversal dimensions A of each longitudinal channel 9, which are smaller than the relative transversal dimensions D of the single blisters 3*a*.

The exceeding articles 2 removed by the brush 13 are taken over, at a lower level with respect to the blister band 3, by the conveying belt 14, and then conveyed to the inlet section 1*b* of the hopper 1.

The plates 8 of the grid G extend longitudinally beyond the support structure 4, downstream as well as upstream thereof with respect to the direction W, in order to ensure complete filling of the blisters 3*a*.

According to another embodiment, it is possible to obtain the same relative motion between the grid G and the blister band 3 by moving the blister band 3 with respect to the grid G, instead of moving the grid G with respect to the blister band 3.

This can be easily obtained by oscillating means, indicated with a block 20 in FIGS. 2 and 6, integral with the support surface 11 (FIGS. 2 and 6).

Thus, an analogous oscillating motion of the blister band 3 is obtained, in a direction M, transversal to the direction W and parallel to the direction L, with respect to the grid G, situated above and now motionless, between the entering position K (FIG. 6*a*) to the stabilization position J (FIG. 6*b*).

In the examined case, during the transition from the position K to the position J, the axis of the each blister 3*a* is displaced by the same value Delta, analogous to the displacement of the longitudinal axis of each plate 8 in the previous case, in which the grid G was oscillating with respect to the blister band 3.

Obviously, this occurs if the oscillating means 10, 20 have in both cases the same oscillation amplitude.

It is obvious that the oscillation amplitude, as well as the oscillation frequency can be adjusted simultaneously and/or separately within predetermined working intervals.

According to another embodiment, the device includes first oscillating means 10, fastened to the grid G, and second oscillating means 20, fastened to the surface 11 supporting and guiding the blister band 3, in order to generate simultaneous oscillating motions of the grid G and the surface 11, with the amplitude and frequency of both oscillating motions being adjustable.

The oscillation of the grid G and the blister band 3 support and guide surface 11 have the same characteristics as described previously in case of single oscillation.

In the described embodiments, the oscillation of the moving part is intended with respect to planes substantially parallel to the blister band 3 in one case, and to the grid G in the other case.

Besides the relative oscillating motions of the grid G and the blister band 3 and the band 3 movement, the guiding of the articles 2 inside the longitudinal channels 9 can be facilitated by the presence of the orientable guiding means 12 (only four of which are shown in FIG. 2), e.g. tabs of flexible material, brushes or the like, supported by the grid G and/or by the chutes 6*a*, 6*b*.

However, it is to be pointed out that the introducing of each article 2 into the relative blister 3*a* is facilitated not only by the relative motion between the grid G and the blister band 3 one with respect to the other in the directions L, M, but also by the push of the gravity acting on the articles 2 situated over the blister.

A plurality of windows 5 (three of which shown in FIG. 2) are made in the support structure 4 in order to obtain reduced inertial parameters thereof.

The cross-section of the bars 7 supporting the longitudinal plates 8, at least two per each plate, can be indifferently circular and/or polygonal (triangular, quadrate, rectangular, etc.).

The proposed device for feeding articles 2 to a blister band 3 situated below is particularly indicated for articles 2, which are tablets, pills, capsules and the like, in particular rhomboid and/or oblong.

The proposed device 100 according to the profoundly described embodiments, assures the best filling of each blister 3*a* of the blister band 3 with one article 2, avoiding any kind of damage to the treated articles and the blister band.

The above mentioned advantages are obtained by a device realized by a simple technical solution, which assures high reliability and productivity standards in any working condition, so as to ensure correct packaging of the relative articles into the corresponding blister bands.

Moreover, it is to be pointed out that the above described device includes few and simple to realize elements, which lowers the production costs.

It is understood that what above, has been described as a pure, not limitative example, therefore, possible variants resulting from the use and practice of the invention remain within the protective scope of the present technical solution, as described above and claimed hereinafter.

What is claimed is:

1. A device (100) for feeding articles (2) to a blister band (3) moving longitudinally in a forward direction (W) and having at least one row of blisters (3*a*) made therein for receiving corresponding articles (2), with said row of blisters being parallel to the direction (W), said device being characterized in that it includes:

at least one grid (G) situated over said blister band (3), very close thereto, and featuring at least one longitudinal channel (9), matching with said longitudinal row of blisters (3*a*), said articles (2) being moved to said longitudinal channel (9);

a station (101) for feeding said articles (2) to said grid (G);

first oscillating means and second oscillating means (10, 20) for generating a relative motion between said grid (G) and said blister band (3), so that said longitudinal row blisters (3*a*) is alternately partially closed and opened to facilitate stabile introduction of the articles (2) in corresponding blisters (3*a*) present along said longitudinal channel (9).

2. A device, according to claim 1, wherein said longitudinal channel (9) is defined by a first and second lower edges (60*a*,60*b*) of relative first chute and second chute (6*a*, 6*b*), said first chute and second chute (6*a*,6*b*) being supported by a support structure (4) situated over said blister band (3), with said chutes (6*a*,6*b*) conveying and delimiting said articles (2), coming from said feeding station (101), on said grid (G).

3. A device, according to claim 2, wherein said grid (G) is defined by a plurality of longitudinal plates (8), parallel one to another and extending along said movement direction (W), said longitudinal plates (8) being situated very close to said blister band (3), each of said plates (8) being carried by at least two supporting bars (7), whose upper part is fastened to said support structure (4), said longitudinal plates (8) defining, together with said lower edges (60*a*,60*b*), said longitudinal channels (9) in a number equal to the number of longitudinal rows of blisters (3*a*) in said blister band (3).

4. A device, according to claim 1, wherein said first oscillating means (10) are fastened to said grid (G) to generate oscillating motion of the latter along planes, which are substantially parallel to said blister band (3).

5. A device, according to claim 4, wherein said grid (G) oscillates along a direction (L) transversal to the movement direction (W) of said blister band (3).

6. A device, according to claim 1, wherein said second oscillating means (20) are fastened to means (11) for supporting and guiding said blister band (3) to generate oscillating motion of said supporting and guiding means (11) along planes, which are substantially parallel to said grid (G).

7. A device, according to claim 6, wherein said means (11) for supporting and guiding said blister band (3) oscillate along a direction (M) transversal to the movement direction (W) of said blister band (3).

8. A device, according to claim 1, wherein the transversal dimensions (A) of said longitudinal channel (9) are smaller than the transversal dimensions (D) of said blisters (3*a*).

9. A device, according to claim 1, further including deviating means (13) situated downstream of said support structure (4) and extending along said forward direction (W), very close to said blister band (3), said deviating means (13) being aimed at removing exceeding articles (2) from said blister band (3).

10. A device, according to claim 9, further including collecting means (14), situated downstream of said grid (G) with respect to said forward direction (W), close to said deviating means (13), said collecting means (14) being provided for taking over said articles (2) removed from said blister band (3) and for moving said removed articles to said feeding station (101).

11. A device, according to claim 1, further including orientable guiding means (12) supported by the grid (G) and aimed at facilitating conveying of said articles (2) in said longitudinal channel (9).

12. A device, according to claim 11, wherein said guiding means (12) are supported by lower edges (60*a*,60*b*) of chutes (6*a*,6*b*) supported by a support structure (4) situated over said blister band (3), with said chutes (6*a*,6*b*) conveying and delimiting said articles (2), coming from said feeding station (101), on said grid (G).

13. A device, according to claim 11, wherein said guiding means (12) are tabs of flexible material.

14. A device, according to claim 3, wherein the cross section of said bars (7) supporting the longitudinal plates (8) is circular or polygonal.

15. A device, according to claim 3, wherein the longitudinal dimensions of said longitudinal plates (8) are bigger than the longitudinal dimensions of said support structure (4).

16. A device, according to claim 1, wherein said oscillating means (10,20) include first oscillating means (10) fastened to said grid (G) to generate a relative oscillating motion thereof along planes substantially parallel to the blister ban d (3), and second oscillating means (20) fastened to blister band supporting and guiding means (11) to generate a relative oscillating motion thereof along planes substantially parallel to the grid (G).

17. A device, according to claim 16, wherein said grid (G) oscillates crosswise to the forward direction (W) of said blister band (3), while said blister band supporting and guiding means (11) oscillate crosswise to the same forward direction (W).

18. A device, according to claim 10, wherein said collecting means (14) include a close-loop conveying belt, equipped with crossbars (14*a*) for collecting said articles (2) removed from the blister band (3) and for conveying the removed articles to said feeding station.

19. A device, according to claim 9, wherein said deviating means (13) include a brush situated very close to said blister band (3).

* * * * *